US005658870A

United States Patent [19]

Leu

[11] Patent Number: 5,658,870

[45] Date of Patent: Aug. 19, 1997

[54] COMPOSITION OF SUPER MOLECULE ACTIVE SOLID CLEANING AGENT

[76] Inventor: Shiow Jiuan Freida Leu, No. 487, Noan Noan Street, Noan Noan District, Keelung Ctiy, Taiwan

[21] Appl. No.: 721,045

[22] Filed: Sep. 26, 1996

[51] Int. Cl.[6] ..... C11D 1/83; C11D 3/08; C11D 3/10; C11D 3/22

[52] U.S. Cl. ..... 510/276; 510/344; 510/349; 510/354; 510/445; 510/446; 510/456; 510/457; 510/473; 510/488; 510/509

[58] Field of Search ..... 510/276, 344, 510/349, 394, 445, 446, 456, 457, 473, 488, 509

[56] References Cited

U.S. PATENT DOCUMENTS

| | | | |
|---|---|---|---|
| 3,945,951 | 3/1976 | Arai et al. | 510/351 |
| 3,951,839 | 4/1976 | Mino et al. | 510/309 |
| 4,028,282 | 6/1977 | Okumura et al. | 510/378 |
| 4,163,732 | 8/1979 | Sai et al. | 510/377 |
| 4,741,842 | 5/1988 | Adams | 510/330 |
| 5,158,700 | 10/1992 | Sotoya et al. | 252/186.38 |
| 5,330,677 | 7/1994 | Sotoya et al. | 252/186.38 |

*Primary Examiner*—Paul Lieberman
*Assistant Examiner*—Kery A. Fries
*Attorney, Agent, or Firm*—Bacon and Thomas

[57] ABSTRACT

A composition of super molecule active solid cleaning agent manufactured from super molecules and inorganic chemicals consisting of suitable amounts in weight percent of an anionic surface active agent, a sodium carbonate, a sodium silicate, a fluorescent whitening agent, a carboxymethyl cellulose, a non-ionic surface active agent, a di-sodium edetate, an oleic acid and an essence. Water molecules can be activated by the active solid particles as they are immersed in the water. The active solid particles may rub with each other to generate excessive amount of negative hydroxyl ions (OH) in water. Accordingly, the pH value in water increases and the water molecules are activated. As a result, the activated molecules of water may readily penetrate into the tissue of the fabric to weaken and soften the connection between the dirt and tissue of the fabric. The dirt attached to fabric can be readily removed.

8 Claims, No Drawings

COMPOSITION OF SUPER MOLECULE ACTIVE SOLID CLEANING AGENT

FIELD OF THE INVENTION

The present invention relates to a solid cleaning agent, more particularly, to a super molecule active solid cleaning agent which is manufactured from super molecule chemicals and inorganic chemicals with specific percentages in weight. This resulting active solid cleaning agent is insoluble in water and provides a sound cleaning effect and can be used as a cleaning agent substitute for the conventional cleaning agent.

DESCRIPTION OF THE PRIOR ART

Following the development of the communistic civilization as well as industrialization, the water resources in our global environment has deteriorated day by day. The key pollution factor is a result of the waste water from industry and daily waste. The main source of our daily waste is from the home, since synthetic cleaning agents (compound washing powders) have been used in excess in each home. On the other hand, the washing machine has also deteriorated this situation.

The main composition of the synthetic cleaning agent consists of branched chain sodium alkylbenzene sulfonate (ABS), straight chain sodium alkylbenzene sulfonate (LAS), and sodium alkyl sulfonate (SAS). Since these chemicals have a considerably firm stability, they are hard to decompose. When these chemicals are accumulated in a river or a lake, they may cause a red tide effect or other kind of pollution. On the other hand, it is believed that the excess use of compound washing powders may also cause allergies, lower the blood index, and increase the women blood disorder. Even some experts believe that the ABS plays a key role in cancer.

During the limited setting period in a washing machine, the solubility of the synthetic cleaning agents (compound washing powders) are incomplete or in a saturated stage as excessive amounts are used. Many of the agents are flushed to drainage together with the discharge of the waste water. Not only will this cleaning agent be wasted, but will also cause great pollution of water resources. On the other hand, according to worldwide estimation, billions of tons of cleaning agent have been used each year, and consequently a great quantity of harmful chemicals have been flushed into our water resources.

The conventional cleaning agent, for example the compound washing powder, features light weight, large bulk size and large consumption. As a result, it brings inconvenience both to packaging, transportation and storage. In order to decrease the pollution by the washing powder, many a non-phosphor, low-phosphor and concentrated or super concentrated cleaning agent have been developed and put to the market. They have indeed attenuated the pollution to some degree.

Recently, a cleaning agent made from an inorganic material, such as the silicate, has been introduced into the Japanese market. Nevertheless, it is unacceptable to the consumer since it has a poor cleaning effect. The manufacturer claims that this inorganic cleaning agent shall be used with the conventional cleaning agent, at about one fourth the volume. In light of this, it is very inconvenient to use this inorganic cleaning agent. As a result, it has been hard to promote it.

SUMMARY OF THE INVENTION

It is the object of this invention to provide a super molecule active solid cleaning agent which can be used as a substitute for the conventional compound washing powder or synthetic cleaning agent.

According to one preferred embodiment of the present invention, this super molecule active solid cleaning agent is manufactured from super molecule chemicals and inorganic chemicals with specific percentages in weight. When this active solid cleaning agent is put into washing machine, the pH value of water can be changed and the dirt attached to the cloth can be readily emulsified to be removed from the cloth.

According to one aspect of the present invention, the active solid cleaning agent can be reused for several times without adding conventional compound washing powder. In light of this, no pollution will be generated. It is really environment friendly.

According to one aspect of the present invention, the active solid cleaning agent can be made into particles with circular, cubic, slab or other irregular shapes. It can be also put into a porous container to increase the contacting surface. In one preferred embodiment, the active solid cleaning agent is made into a spherical shape since it has the smallest surface area. Accordingly, this may prolong its releasing time and increase its service life. On the other hand, the particle weight of each particle is lower than 0.15 gram.

DETAILED DESCRIPTION OF PREFERRED EMBODIMENT

The super molecule active solid cleaning is consists of an anionic surface active agent, sodium carbonate ($Na_2Co_3$), sodium silicate ($Na_2Sio_3$), a fluorescent whitening agent, a carboxymethyl cellulose, a non-ionic surface active agent, a di-sodium edetate, an oleic acid and an essence with specific percentages in weight.

The percentages in weight are shown as follows.

| | |
|---|---|
| anionic surface active agent | 27.5% |
| sodium carbonate | 29% |
| sodium silicate | 17.5 |
| fluorescent whitening agent | 0.7% |
| carboxymethyl cellulose | 0.4% |
| non-ionic surface active agent | 10% |
| di-sodium edetate | 0.002% |
| oleic acid | 0.002% |
| essence | 0.4% |

The prescribed materials are crushed and ground into powder. Suitable amounts of those ground materials are then sieved and mixed in a mixer completely and thoroughly. Then the mixed material is put into a quick-freezer until the temperature goes below minus 30° C. Afterward, the mixed material is processed to form solid particles is processed into pellets firstly and then cut into particles. The particle shaped material is then placed into a revolving electric oven to solidify at 60 to 150 degrees Celsius. When the mixed particles are heated within the electric oven, they may soon become dynamic and active solid particles. Normally, the particles shall be stored in a dry environment where the room temperature shall not exceed 35 degrees Celsius.

The cleaning effect and principle of the super molecule active solid cleaning agent are described as below.

The super molecule active solid cleaning agent is composed of super molecule chemicals and inorganic chemicals to form a skeleton releasing agent. When this skeleton releasing agent is dispensed homogeneously within the water, it may readily and quickly release a plurality of active agents to change the pH value of the water. Consequently, the water is adapted and modified to have a cleaning effect to remove the dirt attached on the cloth.

Normally, these active solid particles are put into a porous container in such a manner that the active solid particles may rub with each other to generate excessive amounts of negative hydroxyl ions (OH) in water. Accordingly, the pH value in water increases and the water molecules are activated. As a result, the activated molecules of water may readily penetrate into the tissue of the fabric to weaken and soften the connection between the dirt and tissue of the fabric. On the other hand, the excessive amount of hydroxyl will also form an interface active agent. This interface active agent may readily moisten and emulsify the dirt. As the fabric is also strongly agitated by the blade of the washing machine, the dirt is readily removed from the fabric. By the way, the active agent will still attach to the fabric to prevent the dirt from depositing again. As a result, the floating dirt may easily be flushed out in the discharge cycle. At last, the fabric is clean. This is really a novel cleaning agent which is a combination of physical and chemical processes.

In a preferred embodiment, the shape, weight and composition of the active solid particles can be embodied in the following ranges.

1. Shape: There is no certain limitation of the shape of the super molecule active solid particles. They can be readily manufactured into a spherical, cubic, pellet or other irregular shape. Nevertheless, since the sphere has the lowest surface area, accordingly, it has the lowest contacting area with water. As a result, the service life of the spherical active solid particles is prolonged. Besides, when these spherical solid particles are filled within a porous container, the spherical configuration may provide the largest contacting surface area.

2. Weight: It is preferable that the weight of a single particle is below 0.15 gram.

3. The contents of the active solid particle may range in the following percentages.

| | |
|---|---|
| anionic surface active agent | 25–30% |
| sodium carbonate | 25–33% |
| sodium silicate | 15–20% |
| fluorescent whitening agent | 0.5–1% |
| carboxymethyl cellulose | 0.1–0.7% |
| non-ionic surface active agent | 8–12% |
| di-sodium edetate | 0.001–0.003% |
| oleic acid | 0.001–0.003% |
| essence | 0.1–0.7% |

According to the experiment conducted by the inventor, the active solid particles are indeed a novel invention which can be used as a cleaning agent to remove the dirt attached to the fabric. On the other hand, the chemical composition of the present invention is completely different from the conventional compound washing powder or the like. These chemicals are completely harmless to the environment. Moreover, only a small quantity is required each time, and consequently, the impact on the environment is attenuated to the lowest level.

While a particular embodiment of the present invention has been illustrated and described, it would be obvious to those skilled in the art that various other changes and modifications can be made without departing from the spirit and scope of the invention. It is therefore intended to cover in the appended claims all such changes and modifications that are within the scope of the present invention.

I claim:

1. A solid cleaning agent composition consisting of suitable amounts in weight percent of an anionic surface active agent, sodium carbonate, sodium silicate, a fluorescent whitening agent, carboxymethyl cellulose, a non-ionic surface active agent, di-sodium edetate, oleic acid and an essence.

2. A composition as claimed in claim 1, wherein the anionic surface active agent ranges from 25–30%, the sodium carbonate ranges from 25–33%, the sodium silicate ranges from 15–20%, the fluorescent whitening agent ranges from 0.5–1%, the carboxymethyl cellulose ranges from 0.1–0.7%, the non-ionic surface active agent ranges from 8–12%, the di-sodium edetate ranges from 0.001–0.003%, the oleic acid ranges from 0.001–0.003%, and the essence ranges from 0.1–0.7%.

3. A composition as claimed in claim 1, wherein the components are in particle form.

4. A composition as claimed in claim 3, wherein the weight of a single particle is less than 0.15 gram.

5. A composition as claimed in claim 3, wherein the particles are shaped in a spherical configuration.

6. A method of making a solid cleaning agent composition consisting of an anionic surface active agent, sodium carbonate, sodium silicate, a fluorescent whitening agent, carboxymethyl cellulose, a nonionic surface active agent, di-sodium edetate, oleic acid, and essence comprising the steps of:

a) grinding and sieving the components into powder;

b) mixing the powder within a mixer;

c) cooling the mixed powder in a quick-freezer;

d) palliating the cooled powder into particles; and e) heating the particles in an oven to solidify the particles.

7. A method as claimed in claim 6, wherein the powder is cooled within said quick-freezer to a temperature below minus 30 degrees Celsius.

8. A method as claimed in claim 6 wherein the particles are heated in said oven at a temperature of 60–150 degrees Celsius.

* * * * *